United States Patent [19]

Troyer, Jr.

[11] 3,967,554

[45] July 6, 1976

[54] SAFETY AND ARMING DEVICE TIMER

[75] Inventor: David Emanuel Troyer, Jr., Colonial Beach, Va.

[73] Assignee: The United States of America as represented by the Secretary of the Navy, Washington, D.C.

[22] Filed: July 21, 1975

[21] Appl. No.: 597,733

[52] U.S. Cl. ..... 102/70.2 R; 102/70.2 G

[51] Int. Cl.[2] ..... F42C 11/06

[58] Field of Search ..... 102/18, 19.2, 70.2 R, 102/70.2 G, 70.2 P

[56] References Cited

UNITED STATES PATENTS

| | | | |
|---|---|---|---|
| 3,312,869 | 4/1967 | Werner | 102/70.2 R |
| 3,417,700 | 12/1968 | Furlani | 102/70.2 R |
| 3,599,572 | 8/1971 | Brackman | 102/70.2 R |
| 3,682,098 | 8/1972 | Spies | 102/70.2 R |
| 3,763,780 | 10/1973 | Kasinoff | 102/70.2 P |
| 3,793,957 | 2/1974 | Stout et al. | 102/70.2 R |

*Primary Examiner*—Verlin R. Pendegrass

[57] ABSTRACT

The safety and arming device timer is a small, inexpensive, highly accurate electronic time delay compatible with the existing electronics for a safety and arming device for a guided projectile to provide for safe separation of the projectile from the gun.

3 Claims, 2 Drawing Figures

SAFETY AND ARMING DEVICE TIMER

BACKGROUND OF THE INVENTION

The invention is concerned with the arming of a projectile, on a time delay basis, after the projectile leaves the muzzle of the weapon.

Harry Diamond Laboratories developed a safety and arming device for specific use in the 5-inch and 8-inch guided projectiles. The safety and arming device that was developed utilized a mechanical time delay to provide for safe separation of the projectile from the gun. The mechanical delay was inaccurate and bulky.

SUMMARY OF THE INVENTION

The safety and arming device timer of the present invention is an electronic timer which uses simultaneous signals from two sensors and a time delay circuit to arm a munition warhead. The invention includes the charging of a capacitor, the firing of an SCR, and the discharging of the capacitor to operate a piston motor to remove one lock on the safety and arming mechanism. The present invention combines the advantages of light weight and increased accuracy with reduced size.

STATEMENT OF THE OBJECTS OF INVENTION

An object of the invention is to provide an inexpensive, small, highly accurate electronic time delay compatible with existing electronics in a safety and arming device.

Other objects, advantages and novel features of the invention will become apparent from the following detailed description of the invention when considered in conjunction with the accompanying drawings.

DETAILED DESCRIPTION OF THE INVENTION

Figure 1:
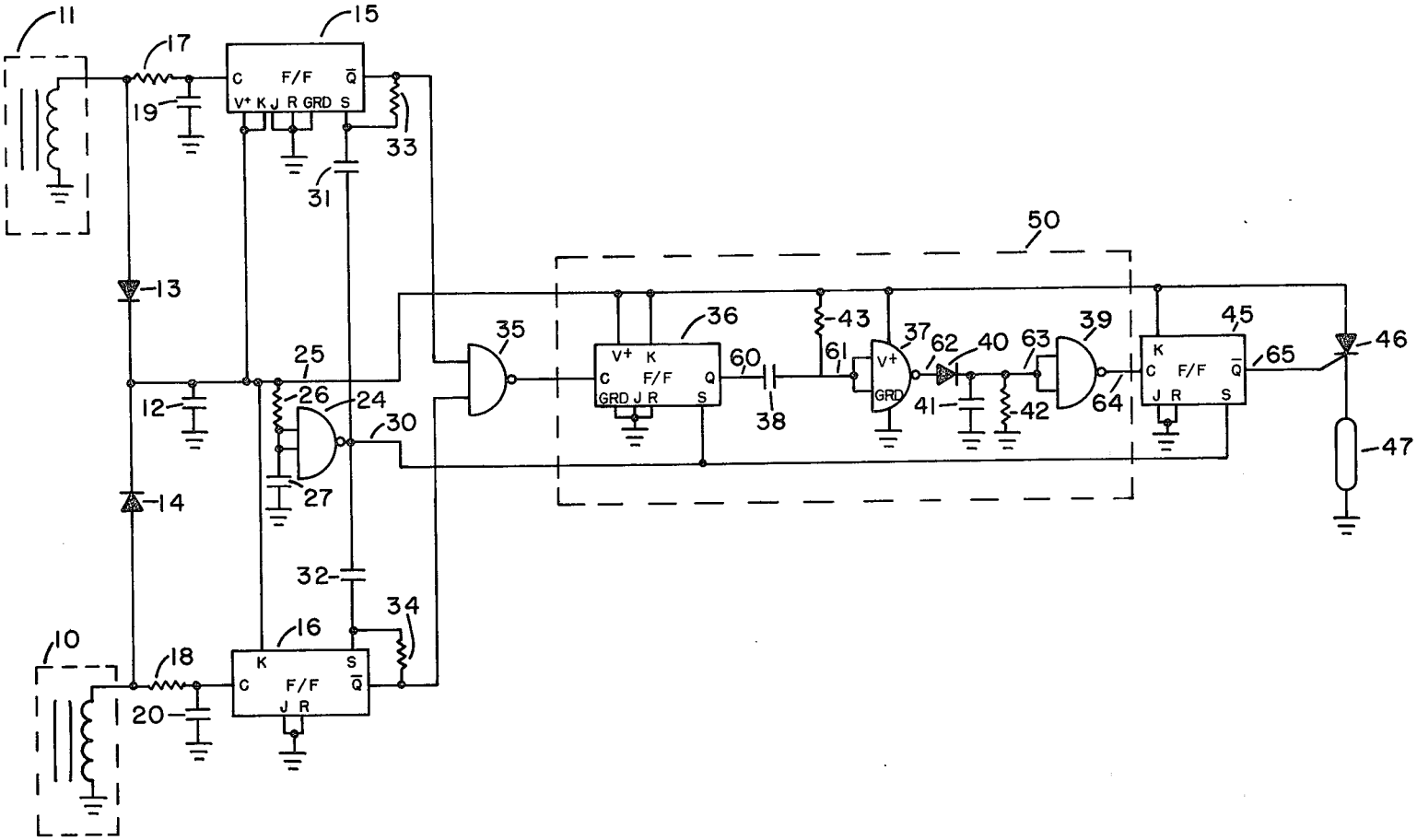
FIG. 1 is a schematic for the safety and arming device.

The safety and arming circuit designed by Harry Diamond Laboratories with the addition of the present electronic timer (reference numeral 50) is shown in FIG. 1. In the description of the drawing specific values are given for resistors and capacitors, and the flip-flops and logic gates are identified. This is done to better enable one to understand the invention and these specific identifications are not to be construed as limitations on the invention.

Induction sensors 10 and 11 are connected to a 3.3$\mu$f, 20 volt capacitor 12 through low current rectifier diodes 13 and 14. Each sensor 10 and 11 is also connected to a clock input C of either flip-flop 15 or 16 through a 100K ohm resistor 17 or 18. A 100pf capacitor 19 or 20 is also connected between the clock input C of flip-flop 15 or 16 and ground. The NAND gate 24 (which is wired as an inverter) is connected to the capacitor voltage line 25 through a 100K ohm resistor 26. A 30pf capacitor 27 is connected between ground and the inputs of NAND gate 24.

The flip-flops 15 and 16 are each ½ of a CD4027AD CMOS integrated circuit which is a dual JK Master Slave flip-flop. The chip is powered at the input $V^+$ by the voltage line 25. The input GRD is the ground pin for the chip and is grounded. The inputs J and R of each flip flop 15 and 16 are also grounded. The input K of each flip-flop 15 and 16 is connected to the voltage line 25. Each set input S is connected to the output 30 of NAND gate 24 through a 150pf capacitor 31 or 32. Each set input S of flip-flops 15 and 16 are also connected to the not true output $\overline{Q}$ through a 680K ohm resistor 33 or 34.

The not true outputs $\overline{Q}$ of flip-flops 15 and 16 are each an input to NAND gate 35. The output of NAND gate 35 is the clock input C of flip-flop 36. The true output Q of flip-flop 36 is connected to the wire-0Red inputs of NAND gate 37 through a 350pf capacitor 38. The output of gate 37 is connected to the wire-0Red inputs of NAND gate 39 through a diode 40. A 350pf capacitor 41 is connected between the cathode of diode 40 and ground. The 1G ohm resistors 42 and 43 are connected so as to avoid current leakage.

The NAND gates 24, 35, 37 and 39 are each ¼ of a CD4011AD CMOS integrated circuit quad-2 input NAND gate. The power is supplied to the chip by the input $V^+$ of gate 37 and the chip is grounded at the ground input GRD of gate 37.

The advantage of two gates (37 and 39) connected as inverters fabricated on the same chip is that they have similar transfer voltages. When two equal RC time constants are used (resistor 43 and capacitor 38 compared to resistor 42 and capacitor 41), the effects of variations in transfer voltage from device to device and temperature variations are effectively cancelled out.

The output of gate 39 is connected to the clock input C of flip-flop 45. Flip-flops 36 and 45 are each ½ of a CD4027AD, dual JK Master Slave flip-flop. The power to the chip is supplied at input $V^+$ of flip-flop 36 and the chip is grounded at input GRD. In both flip-flops, the input K is connected to the voltage line 25, the input S is connected to the set line 30 and the inputs J and R are grounded.

A silicon controlled rectifier 46 is connected to the voltage line 25, the not true output $\overline{Q}$ of flip-flop 45 and a piston actuator 47.

The circuit just described operates such that when the projectile leaves the muzzle with at least a certain minimum velocity, two induction sensors 10 and 11 mounted on the surface skin of the projectile, each develop a voltage pulse. The change in permeability between the end of the barrel and the air inductively induces a voltage in the coil windings of the sensors 10 and 11 as the coils move past the end of the barrel at a specific velocity. The pulses charge a capacitor 12 and energize a NAND gate 24 with an RC time constant set by resistor 26 and capacitor 27. The output 30 of gate 24 sets flip-flops 15, 16, 36 and 45. This set pulse is short and occurs before the data pulse reaches flip-flop 15 and 16 due to their respective RC time constants (resistor 17 and capacitor 19 as well as resistor 18 and capacitor 20). The $\overline{Q}$ outputs of flip-flops 15 and 16 must be coincident at gate 35 for the device to arm, thus preventing false alarms.

Figure 2:
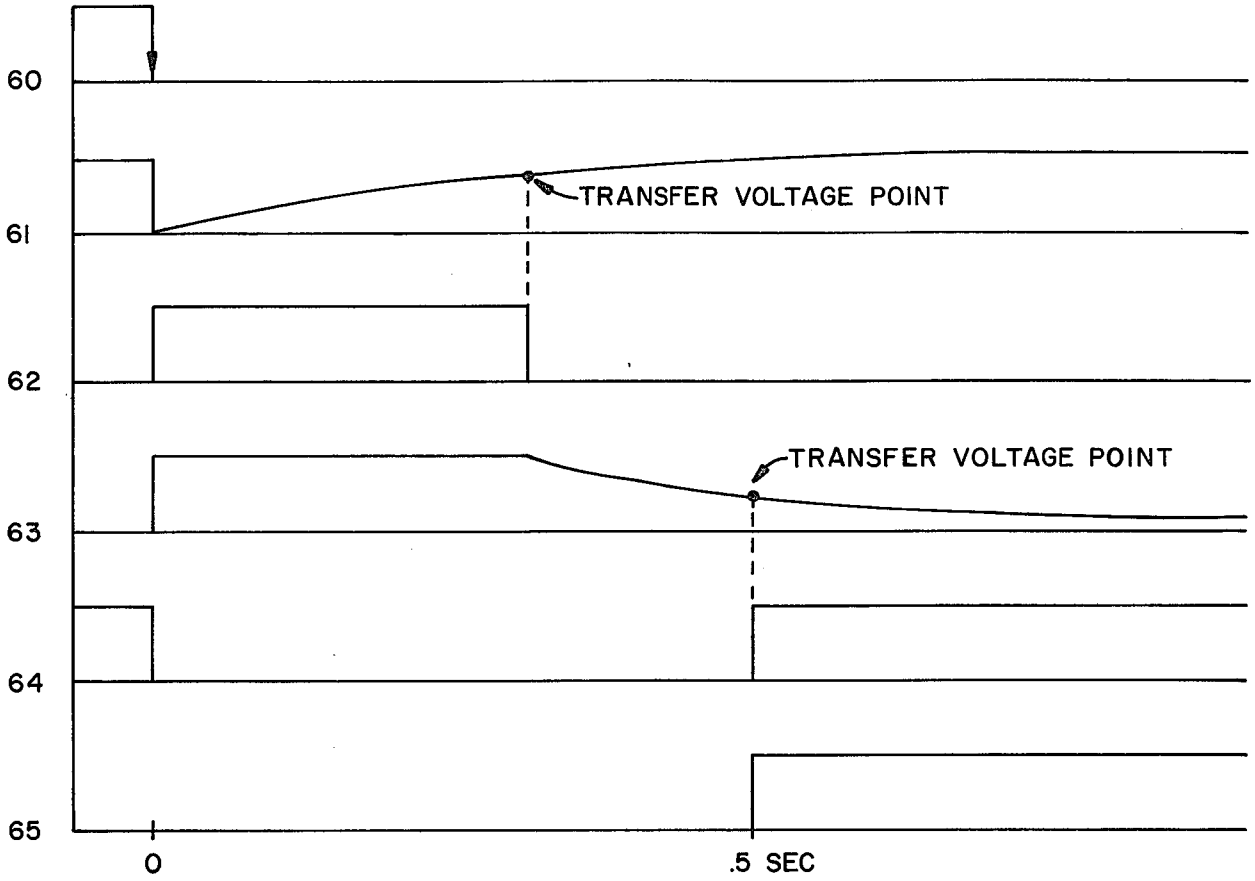
FIG. 2 are voltage waveforms appearing at various points in the circuitry of FIG. 1.

In the quiescent state of the time delay circuit 50 (a compensated monostable multivibrator being driven by a flip-flop), the output of gate 35 is high, hence the input to inverter 37 is high and the output of inverter 37 is low; therefore, the output of inverter 39 is high. When coincident signals are received at gate 35, the output pulse of gate 35 drives flip-flop 36 low, causing a negative going pulse or spike to be introduced into the circuit, as shown in the waveforms of FIG. 2. The time of 0.5 seconds shown in FIG. 2, is for example only. Capacitor 38 becomes negatively charged to ground and the output of inverter 37 becomes high. Capacitor 41 then charges to the voltage along line 25 through the diode 40 and inverter 37, and the output of inverter 39 becomes low. As capacitor 38 discharges negatively, it charges through resistor 43 to voltage line 25. (See FIG. 2-61) The output of inverter 37 remains high until the voltage waveform generated by the charge of capacitor 38 passes through the transfer voltage of inverter 37; at that instant its output becomes low. Diode 40 temporarily prevents the discharge of capacitor 41, which was charged when inverter 37 was high (FIG. 2-62). Capacitor 41 then commences to discharge to ground through resistor 42 (FIG. 2-63). The output of inverter 39 remains low until the waveform generated by the discharge of capacitor 41 passes through the transfer voltage point of inverter 39, at that point the output returns to its high state (FIG. 2-64).

When inverter 39 returns to its high state, flip-flop 45 fires an SCR 46 (FIG. 2-65) which allows the capacitor 12 to discharge through a piston motor 47. The piston removes one lock on the safety and arming mechanism that arms the warhead of the projectile.

Obviously many modifications and variations of the present invention are possible in the light of the above teachings. It is therefore to be understood that within the scope of the appended claims the invention may be practiced otherwise than as specifically described.

What is claimed is:

1. A safety and arming device for a guided projectile to provide for safe separation of the projectile from the gun before arming comprising:

means mounted on said projectile inductively inducing a plurality of voltage pulses as the projectile is fired from a gun;

a safety and arming coincidence circuit responsive to coinciding voltage pulses produced by the induction means;

a flip-flop responsive to the output of said coincidence circuit;

a compensated monostable multivibrator driven by said flip-flop, said flip-flop and said multivibrator operating as an electronic timer wherein the output of said coincidence circuit is delayed for a predetermined period; and means for arming a warhead responsive to the output of said timer.

2. The device of claim 1 wherein said flip-flop is a JK Master Slave flip-flop.

3. The device of claim 1 wherein said compensated monostable multivibrator circuit comprises:

a voltage source;

a first inverter powered by said voltage source;

a first capacitor connected between the output of said flip-flop and the input of said first inverter such that it becomes negatively charged to ground when said voltage source produces a negative going pulse;

a first resistor to avoid current leakage connected between the input to said first inverter and said voltage source;

a second inverter powered by said voltage source;

a diode wherein the anode of said diode is connected to the output of said first inverter, and the cathode of said diode is connected to the input of said second inverter;

a second resistor to avoid current leakage connected between the cathode of said diode and ground; and a second capacitor wherein the cathode of said second capacitor is connected to the cathode of said diode and the anode of said second capacitor is grounded.

* * * * *